US007007700B2

(12) United States Patent
Burroughs

(10) Patent No.: US 7,007,700 B2
(45) Date of Patent: Mar. 7, 2006

(54) COSMETIC HOLDER APPARATUS

(76) Inventor: Julie Ann Burroughs, 14870 NE. 68th St., Jones, OK (US) 73049

( * ) Notice: Subject to any disclaimer, the term of this patent is extended or adjusted under 35 U.S.C. 154(b) by 30 days.

(21) Appl. No.: 10/228,895

(22) Filed: Oct. 25, 2002

(65) Prior Publication Data

US 2003/0062060 A1 Apr. 3, 2003

Related U.S. Application Data

(60) Provisional application No. 60/326,448, filed on Oct. 3, 2001.

(51) Int. Cl.
*A45D 33/28* (2006.01)
*A45D 33/24* (2006.01)

(52) U.S. Cl. ..... 132/297; 132/294

(58) Field of Classification Search ..... 132/297, 132/294, 314, 317, 318, 319, 320; 206/581, 206/361, 823; 401/123, 124, 125; 220/736, 220/833, 836

See application file for complete search history.

(56) References Cited

U.S. PATENT DOCUMENTS

| | | | | | |
|---|---|---|---|---|---|
| 390,089 | A * | 9/1888 | McClellan | 132/294 |
| 1,676,012 | A * | 7/1928 | Fascetta | 132/294 |
| 2,333,889 | A | 11/1943 | Ruekberg | |
| 2,444,376 | A | 6/1948 | Seaver | |
| 2,840,229 | A | 6/1958 | Hopgood | |
| 2,872,034 | A * | 2/1959 | Harris | 401/61 |
| 4,679,692 | A | 7/1987 | Davey | |
| 4,726,387 | A * | 2/1988 | Sarica | 132/294 |
| 5,226,541 | A * | 7/1993 | Huang | 206/581 |
| 5,318,053 | A * | 6/1994 | Barnhart | 132/297 |
| 5,373,940 | A | 12/1994 | Hillelson | |
| 5,441,153 | A | 8/1995 | Lahaye | |
| 5,701,921 | A * | 12/1997 | Father et al. | 132/309 |
| 6,035,865 | A | 3/2000 | Krieger | |
| 6,141,838 | A * | 11/2000 | Cooper | 24/339 |
| 6,145,515 | A * | 11/2000 | Wu | 132/295 |
| 6,298,863 | B1 * | 10/2001 | Byun | 132/294 |

* cited by examiner

*Primary Examiner*—John J. Wilson
*Assistant Examiner*—Robyn Doan
(74) *Attorney, Agent, or Firm*—James F. Harvey, III

(57) ABSTRACT

The present invention provides a cosmetic holder apparatus for holding a lipstick tube and either a lip liner, a lip brush, or both in a common protected container to prevent damage to the smaller items when carried in a purse or handbag and to allow them to be conveniently accessed with one retrieval operation. The cosmetic holder apparatus is comprised of a base and cover that contain a lipstick tube and at least one lip liner or lip brush. The lipstick tube is contained in a first portion of the base and the lip liner or lip brush is contained in a second portion of the base. The cover encloses the cosmetic items and frictionally engages the base to contain the items therein.

7 Claims, 2 Drawing Sheets

COSMETIC HOLDER APPARATUS

CROSS-REFERENCES TO RELATED APPLICATIONS

This patent application claims priority based upon the following provisional patent application: No. 60/326,448, filed on Oct. 3, 2001, of the same or similar title.

BACKGROUND OF THE INVENTION

The present invention is concerned with the field of cosmetic containers and holders. More specifically, the present invention is concerned with a cosmetic holder apparatus comprised of a base and cover that contain a lipstick tube and at least one lip liner or lip brush.

Cosmetic articles and makeup are among the personal items that women use to enhance the appearance of certain parts or features of their faces. The cosmetic articles are designed for specific parts of the face and typically consist of lipstick tubes, eyeliner pencils or applicators, mascara brushes, powder puffs or applicators for the nose, cheeks and adjacent facial areas, and the like. Since makeup must be reapplied or touched up over the course of the day or evening, the wearer must have ready access to makeup and means of application. With lip makeup, i.e. lipstick, the makeup and applicator thereof consist of a tube of lipstick of the appropriate color and a lip liner or lipstick brush for a more precise application or delineation of the lipstick.

The lipstick brush and lip liner are usually stored and transported by the user within a pocketbook or similar carrying article or case. Pocketbooks are concerned with a main holding area for miscellaneous items, such as individual articles of makeup, pens, hair clips, and the like, and it is common for a lip liner or lipstick brush to be placed therein. In such a location, a lipstick brush and lip liner become mixed with the other items and are frequently difficult to find and retrieve and possibly damaged over time as they are subject to being jostled around, being struck, or impacted by other items within the interior of the pocketbook, purse, or carrying case. The tip of the lip liner is especially vulnerable to breakage.

What is needed to overcome the aforementioned disadvantages of storing and transporting lipstick tubes and lip liners or lip brushes is the provision of a cosmetic holder apparatus that is designed to receive, store, and dispense a lipstick tube and at least one lip liner, the holder consisting of a base into which the lipstick tube and lip liner are inserted and the lipstick tube is rotatably dispensed. A cover should enclose at least the lipstick tube and optionally the lip liner, the cover fitting over the base preferably in a manner that avoids disassociation with the base from being pried loose by other objects within its storage location.

Numerous designs for cosmetic containers have been proposed by others. Even though these designs may be suitable for the specific individual purposes to which they address, they would not be suitable for the purposes of the present invention, as such designs are generally elaborate and cumbersome to use within the confining area of a pocketbook, purse, or carrying case. These designs are exemplified by U.S. Pat. No. 4,679,692, Containers for Cosmetics, issued to Davey on Jul. 14, 1987; U.S. Pat. No. 5,373,940, Lipstick-Pill Box Container, issued to Hillelson on Dec. 20, 1994; U.S. Pat. No. 5,441,153, Lipstick and Container System, issued to Lahaye on Aug. 15, 1995; U.S. Pat. No. 6,035,865, Cosmetic Holder Assembly, issued to Krieger on Mar. 14, 2000; and U.S. Pat. No. 6,145,515, Multi-Color Lipstick Case, issued to Wu on Nov. 14, 2000.

As such, it may be appreciated that there is a continuing need for a new and improved cosmetic holder apparatus for storage of a lipstick tube and a lip liner that permits these cosmetic items to be kept in close proximity for quick and convenient retrieval for use and protected from damage when placed within a pocketbook or carrying article, and that dispenses the lipstick from its stored position. In these respects, the present invention substantially departs from the conventional concepts and designs of the prior art, and in so doing provides an apparatus that substantially fulfills this need. Additionally, the prior patents and commercial techniques do not suggest the present inventive combination of component elements arranged and configured as disclosed herein.

The present invention achieves its intended purposes, objects, and advantages through a new, useful, and unobvious combination of method steps and component elements, with the use of a minimum number of functioning parts, at a reasonable cost to manufacture, and by employing only readily available materials.

SUMMARY OF THE INVENTION

The present invention, which will be described in greater detail hereinafter, is concerned with a cosmetic holder apparatus comprised of a base and cover that contain a lipstick tube and at least one lip liner or lip brush. The lipstick tube is contained in a first portion of the base and the lip liner or lip brush is contained in a second portion of the base. The invention overcomes all of the shortcomings listed previously, in addition to novel aspects that will be described in detail hereinafter.

In a first embodiment of the invention, a cosmetic holder apparatus is comprised of a base and a cover, the cover fabricated for releasable attachment to the base. The base is comprised of a rectangular portion and a cylindrical portion, the cylindrical portion being attached to or formed into one corner of the base. An aperture, located centrally into the rectangular portion, is designed for receipt of a lipstick tube, and an aperture formed into the cylindrical portion is designed for receipt of a lip liner or brush. The base and the lipstick tube are disposed so that opposing rotation of the base with respect to the tube will elevate the lipstick to a desired level determined by the user. The cover may be constructed with a rectangular portion and a cylindrical portion, so that it fits in snug arrangement to a corresponding rectangular portion and cylindrical portion of the base. When the cover is affixed to the base with lipstick tube and lip liner inserted therein, the cover encloses said lipstick tube and optionally encloses the lip liner.

In a second embodiment of the invention, a cosmetic holder apparatus is comprised of a base that is further comprised of a rectangular portion and a protuberance affixed to or fashioned into a sidewall of the base. An aperture for a lipstick tube is formed into the base, and two apertures for lip liners are fashioned into the protuberance. The base and the lipstick tube are disposed so that opposed rotation by either the base or the tube with respect to the tube or the base, respectively, will elevate the lipstick to a desired level determined by a user of the apparatus. The cover may consist of a rectangular portion and a protuberance, which attaches in snug engagement to the corresponding rectangular portion and protuberance. The cover encloses the lipstick tube and may optionally enclose the lip liners.

In a third embodiment of the invention, a cosmetic holder apparatus is comprised of a base that is further comprised solely of a rectangular portion with an aperture for receipt of a lipstick tube. The base and the lipstick tube are disposed so that rotation of one with respect to the other will elevate the lipstick to a user's desired level. The cover, which attaches to the base in snug arrangement, may be constructed on one sidewall thereof with two clips that receive and hold the lip liner or lip brush so that it is aligned along the longitudinal axis of the cover.

The invention, therefore, resides not in any one of these features per se, but rather in the particular combination of all of these embodiments herein disclosed. It is distinguished from the prior art in this particular combination of all of its structures for the functions specified.

In order that the detailed description of the invention may be better understood and that the present contribution to the art can be more fully appreciated, additional features of the invention will be described hereinafter. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention.

In this respect, before explaining at least one embodiment of the invention is not limited in its application to the details of construction and to the arrangements of the components set forth in the following description or illustrated in the drawings. The invention is capable of the embodiments and of being practiced and carried out in various ways. Also, it is to be understood that the phraseology and terminology employed herein are for the purpose description and should not be regarded as limiting.

As such, those skilled in the art will appreciate that the conception, upon which this disclosure is based, may readily be utilized as a basis for the designing of other structures, methods, and systems for carrying out the several purposes of the present invention. Further, this abstract is neither intended to define the invention of the application nor is it intended to be limiting as to the scope of the invention in any way.

Accordingly, it is an object of the invention to provide a low-cost, easy-to-manufacture, and easy-to-market cosmetic holder apparatus.

A further object of the invention is to provide an easy-to-use and versatile cosmetic holder apparatus.

A significant object of the invention is to provide a cosmetic holder apparatus that consists of a base fabricated with a first aperture designed for receipt of a lipstick tube and at least a second aperture into which a lip liner can be inserted and further consisting of a cover, which is releasably attached to the base to enclose said lipstick tube and optionally the lip liner inserted into the base.

A final but very significant object of the invention is to permit the lipstick tube and lip liner to be quickly and easily retrieved from within a pocket book or carrying article by first locating said cosmetic holder apparatus and to provide a cosmetic holder apparatus into which a lipstick tube and a lip liner can be placed for storage and transport without incurring damage during said storage and transport.

For a better understanding of the invention, its operating advantages and the specific objects attained by its uses, reference should be made to the accompanying drawings and descriptive matter in which there are illustrated preferred embodiments of the invention. The foregoing has outlined some of the more pertinent objects of the invention. These objects should be construed to be merely illustrative of some of the more prominent feature and applications of the present invention. Many other beneficial results can be attained by applying the disclosed invention in a different manner or by modifying the invention within the scope of the disclosure. Accordingly, other objects and a fuller understanding of the invention and the detailed description of the preferred embodiments in addition to the scope of the invention illustrated by the accompanying drawings.

BRIEF DESCRIPTION OF THE DRAWINGS

The foregoing and other objects, features and advantages of the invention will become more fully understood from the following description of the preferred embodiments of the invention as illustrated in the accompanying drawings in which like reference characters refer to the same parts throughout different views. The drawings are not necessarily to scale, emphasis instead being placed upon illustrating the principles of the invention.

DETAILED DESCRIPTION OF THE INVENTION

Figure 1:
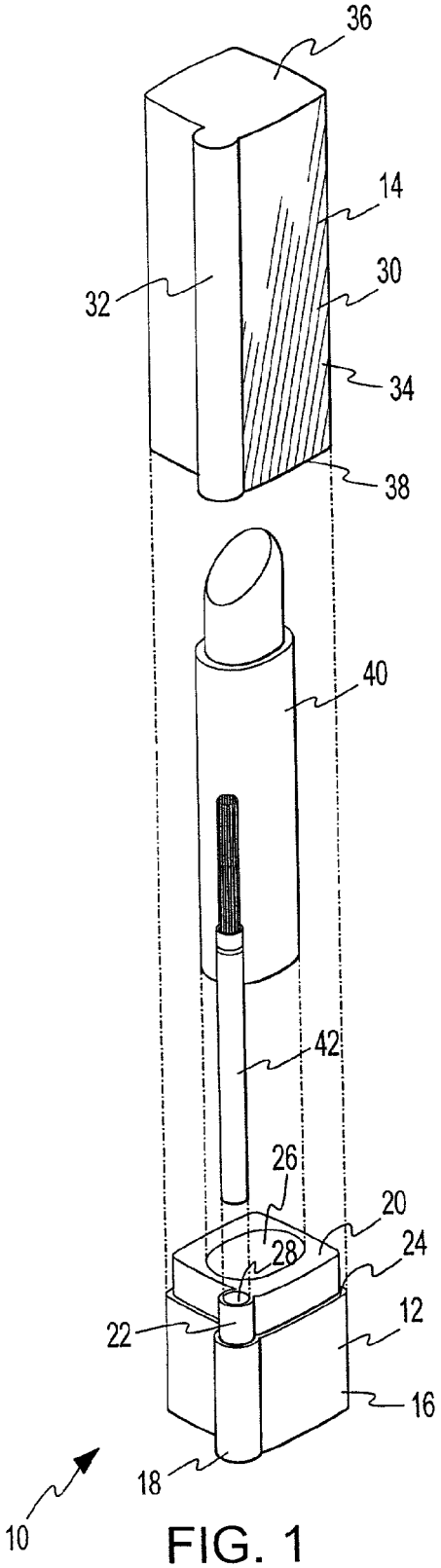
FIG. 1 is perspective view of a first embodiment of a cosmetic holder apparatus in accordance with the present invention illustrating cosmetic articles aligned for placement into said apparatus.

Referring now to the drawings and, in particular, to FIG. 1 wherein there is illustrated a typical embodiment of the cosmetic holder apparatus 10. An embodiment 10 of the present invention is comprised of a base 12 and a cover 14, the cover 14 designed for releasable attachment to the base 12 in frictional or snug engagement. The base 12 consists of a lower rectangular portion 16 and a lower cylindrical portion 18, with the lower cylindrical portion 18 being attached or affixed to one corner of the lower rectangular portion 16. An upper rectangular portion 20 having a lesser perimeter than the lower rectangular portion 16 is attached to or otherwise extends above the lower rectangular portion 16. Similarly, an upper cylindrical portion 22 comprising a lesser diameter than the lower cylindrical portion 18 is attached to or otherwise extends above the lower rectangular portion 16. The point at which the lower rectangular 16 and cylindrical 18 portions and the upper rectangular 20 and cylindrical 22 portions meet the upper rectangular 20 and cylindrical 22 portions is defined by a lip 24 that surrounds or traverses the perimeter of the base 12. A first aperture 26 is located on and into the top side of the upper rectangular portion 20, and a second aperture 28 is situated on and into the top side of the upper cylindrical portion 22.

Referring again to FIG. 1, the cover 14 consists of a rectangular portion 30 and a cylindrical portion 32, the cylindrical portion 32 being attached or affixed to one corner of the rectangular portion 30. The rectangular portion 30 is fabricated of four lateral sidewalls 34 and a top sidewall 36. As illustrated, the cover 14 is aligned over the base 12 with the bottom of the cover 14 designed to be fitted in snug engagement to the base 12, specifically the lower sections of the inside surfaces of the rectangular 30 and cylindrical portions 32 of cover 14 engaging the upper rectangular 20 and cylindrical portions 22 of the base 12, respectively, until a bottom edge 38 of the cover 14 makes eye contact with the lip 24 of the base 12. In this manner, a smooth, continuous aspect of the exterior of base 12 and cover 14 is achieved when they are so engaged, so that the engaged cosmetic holder apparatus does not catch on other objects when inserted into a lady's handbag or purse that might separate cover 14 from base 12.

Figure 2:
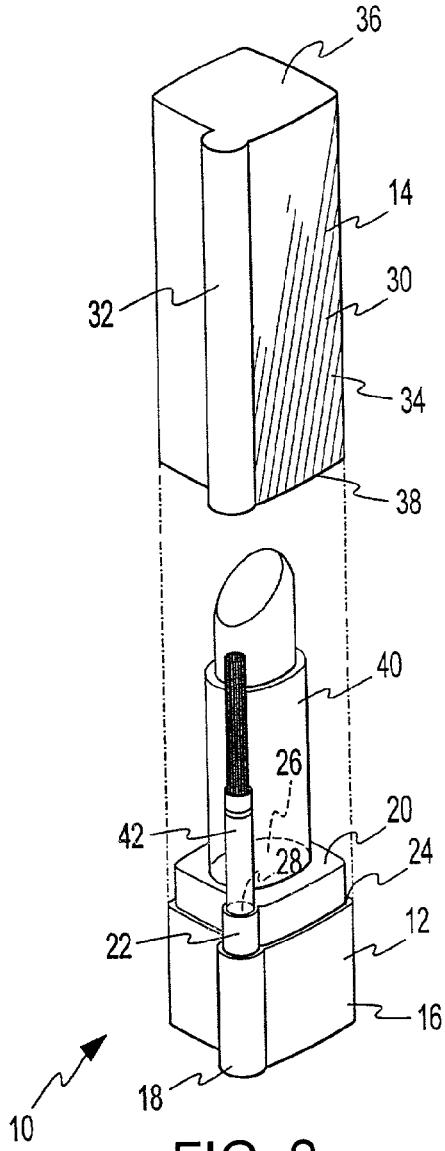
FIG. 2 is a perspective view of a first embodiment of a cosmetic holder apparatus in accordance with the present invention illustrating cosmetic articles aligned for placement into said apparatus.

A lipstick tube 40 is aligned over the base 12 for insertion into the aperture 26 of the upper rectangular portion 20, and a lip liner brush 42 is aligned over the aperture 28 of the upper cylindrical portion 22. As displayed in FIG. 2, the lipstick tube 40 and lip liner brush 42 are fully inserted into respective apertures 26, 28 of the base 12. The base 12 and the lipstick tube 40 are disposed in such a manner that the opposing rotation of one with respect to the other elevates the lipstick to a level desired by a user of the cosmetic holder apparatus 10. The mechanism by which the rotation elevates the lipstick is well known to those skilled in the art, as exemplified in the following: U.S. Pat. No. 2,333,889, Lipstick Receptacle, issued to Ruekberg; U.S. Pat. No. 2,444,376, Lipstick Container, issued to Seaver; and U.S. Pat. No. 2,840,229, Cosmetic Container issued to Hopgood. This art is incorporated by reference for the purposes of illustrating the kinds of lipstick tube mechanisms that may be used with the invention.

Certain variations of this embodiment are contemplated to be within the scope of the invention. Optionally, cover 14 may be fabricated without the cylindrical portion 32 so that it encloses only the lipstick tube 40, leaving lip liner brush 42 exposed. Furthermore, the length of lip liner 42 may be such that it does not extend further beyond base 12 than does lipstick tube 40, so that the cosmetic holder apparatus 10 is kept compact and small for advantageous insertion and transportation in a user's purse. It should also be noted that when the lip liner 42 is inserted tip side down into the base 46, base 46 acts as a protective cover for the lip liner 42. Finally, although the cosmetic articles lipstick tube 40 and lip liner 42 were used illustratively in describing this embodiment, the base 46 may receive cosmetic articles of other variations, such as lip gloss, lip ink, eyeliner applicators, mascara brushes, or any other cosmetic item generally known in the arts.

Figure 3:
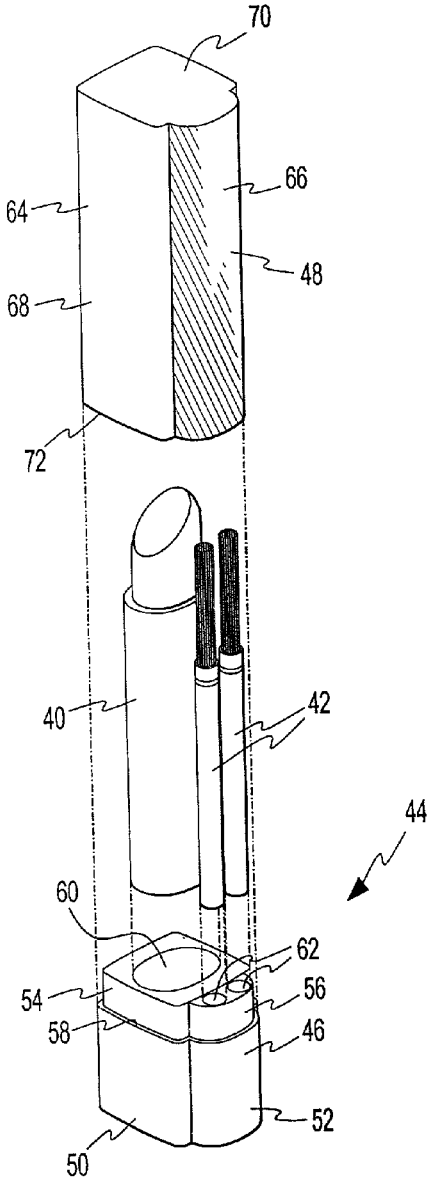
FIG. 3 is a perspective view of a second embodiment of a cosmetic holder apparatus in accordance with the present invention illustrating cosmetic articles aligned for placement into said apparatus.

In FIG. 3, a second embodiment 44 of the cosmetic holder apparatus is illustrated and is comprised of a base 46 and a cover 48. The base 46 consists of a lower rectangular portion 50, lower protuberance 52, upper rectangular portion 54, and upper protuberance 56. The upper rectangular portion 54 and upper protuberance 56 are fabricated with a perimeter less than that of the lower rectangular portion 50 and lower protuberance 52 so that a lip 58 is formed that surrounds or traverses the base 46 at the junction of the upper and lower portions. An aperture 60 is located at the top side of the upper rectangular portion 54, and two apertures 62 are situated at the top side of the upper protuberance 56.

The cover 48 consists of a rectangular portion 64 and a protuberance 66 attached to or formed into the rectangular portion 64. The rectangular portion 64 is further comprised of three lateral sidewalls 68 and a top sidewall 70. A bottom edge 72 is located at the end of the cover 48 opposite to that of the top sidewall 70. The cover 48 is releasably attached in the snug engagement to the base 46 by positioning the lower portion of the cover 48 over the upper rectangular portion 54 and upper protuberance 56 until the bottom edge 72 makes contact with the lip 58.

Figure 4:
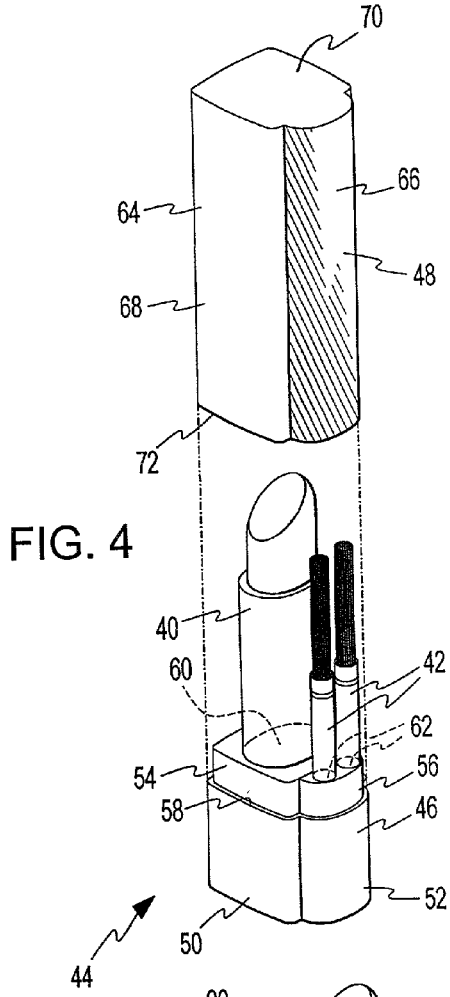
FIG. 4 is a perspective view of a second embodiment of a cosmetic holder apparatus in accordance with the present invention with cosmetic articles positioned within the holder apparatus.

A lipstick tube 40 is aligned over the base 46 for insertion into the aperture 60 of the upper rectangular portion 54, and two lip liner brushes 42 are aligned over apertures 62 of the upper protuberance 56. Note that although two lip liner brushes 42 are illustrated, the concept of the invention does not limit the number of brushes so contained. Provision for more or less lip liner brushes 42 may be made without departing from the scope of the invention, provided that sufficient accommodation is made within cover 46 and the size of base 48. In FIG. 4, the lipstick tube 40 and lip liner brushes 42 are illustrated as fully inserted into their respective apertures 60, 62. The base 46 and the lipstick tube 40 are disposed in such a manner that the opposed rotation of one with respect to the other elevates the lipstick to a level desired by a user of the cosmetic holder apparatus 44. The mechanism by which the rotation elevates the lipstick tube is well known to those skilled in the art, as cited previously.

Certain variations of this embodiment are also contemplated to be within the scope of the invention. Optionally, cover 48 may be fabricated without the protuberance 66 so that it encloses only the lipstick tube 40, leaving lip liner brush 42 exposed. Furthermore, the length of lip liner 42 may be such that it does not extend further beyond base 46 than does lipstick tube 40, so that the cosmetic holder apparatus 44 is kept compact and small for advantageous insertion and transportation in a user's purse. It should also be noted that when the lip liner 42 is inserted tip side down into the base 46, base 46 acts as a protective cover for the lip liner 42. Finally, although the cosmetic articles lipstick tube 40 and lip liner 42 were used illustratively in describing this embodiment, the base 46 may receive cosmetic articles of other variations, such as lip gloss, lip ink, eyeliner applicators, mascara brushes, or any other cosmetic item generally known in the arts.

Figure 5:
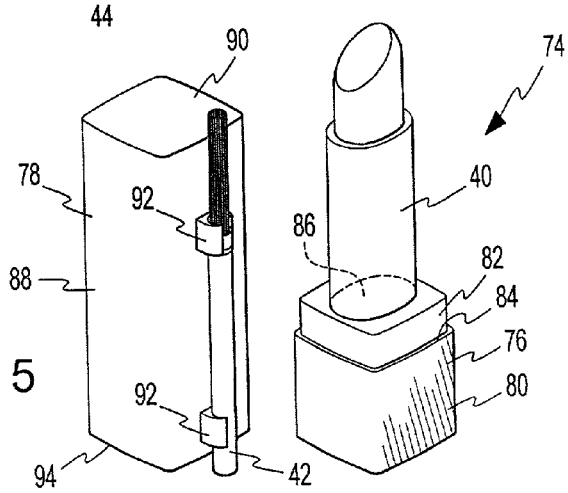
FIG. 5 is a perspective view of a third embodiment of a cosmetic holder apparatus in accordance with the present invention.

A third embodiment 74 of the cosmetic holder apparatus, displayed in FIG. 5, consists of rectangular base 76 and a rectangular cover 78. The base 76 is fabricated of a lower rectangular portion 80 and an upper rectangular portion 82 with a lip 84 surrounding the base 76 at the junction of the lower 80 and upper 82 rectangular portions. An aperture 86 is formed into the upper rectangular portion 82 for receipt of a lipstick tube 40. The base 76 and the lipstick tube 40 are again disposed in so that the opposed rotation of one with respect to the other elevates the lipstick to a level desired by a user of the cosmetic holder apparatus 74. The cover 78 consists of four lateral sidewalls 88 and a top sidewall 90. Two clips 92 are attached to one of the four lateral sidewalls 88 and retain in firm engagement a lip liner brush 42 once inserted therein. Although two clips are shown by way of illustration, the invention is not confined to a particular number of such clips 92. A single clip 42 extending a longitudinal distance may also be used without departing from the scope of the invention, and more than two clips 42 could be similarly used. A bottom edge 94 is located at the end of the cover 78 opposite to that of the top sidewall 90. The cover 78 is attached to the base 76 with the inside surface of the lower portion of the cover 78 enclosing and making contact with the upper rectangular portion 82 until the bottom edge 94 thereof meets the lip 84 of the base 76.

It should be understood that in the foregoing description, a reference to the lip liner brush could be replaced in the description with a reference to a lip liner pencil without departing from the intention or the scope of the invention.

While the invention has been illustrated by disclosing a number of embodiments herein and described in detail in the drawings and foregoing description, the same is to be considered as illustrative and not restrictive in character. It should be understood that only the preferred embodiments have been shown and described and that all changes and modifications that come within the spirit of the invention are desired to be protected. With respect to the above description, it should be further understood that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

While the preferred embodiments of the present invention have been described, additional variations and modifications in those embodiments may occur to those skilled in the art once they learn of the basic inventive concepts. Therefore, it is intended that the appended claims shall be construed to include both the preferred embodiment and all such variations and modifications as fall within the spirit and scope of the invention.

From the foregoing, it will be understood by persons skilled in the art that an improved cosmetic holder apparatus has been provided. The invention is relatively simple and easy to manufacture, yet affords a variety of uses. While the description contains many specifics, these should not be construed as limitations on the scope of the invention, but rather as an exemplification of the preferred embodiments thereof. The foregoing is considered as illustrative only of the principles of the invention. Further, because numerous modifications and changes will readily occur to those skilled in the art, it is not desired to limit the invention to the exact construction and operation shown and described, and accordingly all suitable modifications and equivalents may be resorted to, falling within the scope of the invention. Although this invention has been described in its preferred form with a certain degree of particularity, it is understood that the present disclosure of the preferred form has been made only by way of example and numerous changes in the details of construction and combination and arrangement of parts may be resorted to without departing from the spirit and scope of the invention.

I claim:

1. A cosmetic holder apparatus comprised of a lipstick tube with an advancing mechanism that extends and retracts a lipstick therein;

a cosmetic item;

a base with a first base portion and a second base portion, the base having a first aperture in the first base portion, the first aperture fixedly receiving the lipstick tube and a second aperture in the second base portion removably receiving the cosmetic item; and a cover fabricated for releasable attachment to the base, the cover with a first cover portion for enclosure of the lipstick tube and a second cover portion for enclosure of the cosmetic item, the first cover portion and the second cover portion aligned to fit in snug engagement with the first base portion and the second base portion, wherein the lipstick tube and the cosmetic item are protected by the cover from external damage when the cover is attached to the base, and wherein the lipstick tube is elevated by opposed rotation of the base with respect to the lipstick tube to a selected level through manual action by a user of the apparatus when the cover is removed.

2. The cosmetic holder apparatus in claim 1, wherein the lipstick tube is elevated by opposed rotation of the base with respect to the lipstick tube to a selected level through manual action by a user of the apparatus when the cover is removed.

3. The apparatus described in claim 1, wherein the cosmetic item is a lip liner.

4. The cosmetic holder apparatus in claim 1, wherein the first base portion comprises an upper rectangular section and a lower rectangular section, the upper rectangular section having a lesser perimeter than the lower rectangular section, the second base portion connected to the first base portion at corner thereof, the second base portion comprising an upper cylindrical base section and a lower cylindrical base section, the upper cylindrical base section having a lesser diameter than the lower cylindrical base section, and a lip defined by a junction between the lower rectangular and cylindrical base sections and the upper rectangular and cylindrical base sections, the lip surrounding the perimeter of the base.

5. The cosmetic holder apparatus in claim 4, wherein the cover comprises a rectangular cover section, a cylindrical cover section connected to the rectangular cover section at a corner thereof, and a bottom edge conforming to the lip, wherein the cover encloses both the lipstick tube and the cosmetic item when the cover is brought into snug frictional engagement with the base, the bottom edge of the cover meeting the lip.

6. The cosmetic holder apparatus in claim 1, wherein the first base portion comprises an upper rectangular section and a lower rectangular section, the upper rectangular section having a lesser perimeter than the lower rectangular section, the second base portion comprising a protuberance fashioned into a sidewall of the first base portion, the protuberance further comprising an upper protuberance section and a lower protuberance section, the upper protuberance section having a lesser diameter than the lower protuberance section, and a lip defined by a junction between the lower rectangular and lower protuberance sections and the upper rectangular and upper protuberance sections, the lip surrounding the perimeter of the base.

7. The cosmetic holder apparatus in claim 6, wherein the cover comprises a rectangular cover section, a protuberance cover section fashioned into a side wall of the rectangular cover section, and a bottom edge conforming to the lip, wherein the cover encloses the lipstick tube and the cosmetic item when the cover is brought into snug frictional engagement with the base, the bottom edge of the cover meeting the lip.

* * * * *